US011478396B2

(12) United States Patent
Kirschey

(10) Patent No.: US 11,478,396 B2
(45) Date of Patent: Oct. 25, 2022

(54) ELECTRICALLY DRIVEN WHEELED WALKER

(71) Applicant: Disco Drives Kirschey GmbH, Wuppertal (DE)

(72) Inventor: Gerhard Kirschey, Wuppertal (DE)

(73) Assignee: Disco Drives Kirschey GmbH, Wuppertal (DE)

( * ) Notice: Subject to any disclaimer, the term of this patent is extended or adjusted under 35 U.S.C. 154(b) by 277 days.

(21) Appl. No.: 16/870,154

(22) Filed: May 8, 2020

(65) Prior Publication Data

US 2020/0276075 A1 Sep. 3, 2020

Related U.S. Application Data

(63) Continuation of application No. PCT/EP2018/081514, filed on Nov. 16, 2018.

(30) Foreign Application Priority Data

Nov. 22, 2017 (DE) ..... 202017107072.7

(51) Int. Cl.
*A61H 3/04* (2006.01)

(52) U.S. Cl.
CPC ..... *A61H 3/04* (2013.01); *A61H 2003/043* (2013.01); *A61H 2201/0161* (2013.01); *A61H 2201/1207* (2013.01); *A61H 2201/1633* (2013.01); *A61H 2201/1635* (2013.01)

(58) Field of Classification Search
CPC ..... A61H 3/04; A61H 2003/043; A61H 2201/0161; A61H 2201/1207
See application file for complete search history.

(56) References Cited

U.S. PATENT DOCUMENTS 1,565,719 A * 12/1925 Dunkley ..... B62M 7/14 180/11
4,096,920 A * 6/1978 Heyn ..... B62D 51/02 280/DIG. 4
6,651,993 B1 11/2003 Emerzian
(Continued)

FOREIGN PATENT DOCUMENTS

CN 1886111 A 12/2006
CN 102429789 A 5/2012
(Continued)

*Primary Examiner* — Erez Gurari
(74) *Attorney, Agent, or Firm* — Von Rohrscheidt Patents

(57) ABSTRACT

A wheeled walker including a front wheel pair viewed in a driving direction and a rear wheel pair viewed in the driving direction; a frame including rearward oriented struts, wherein each of the rearward oriented struts supports a rear wheel of the rear wheel pair; a platform attached at the wheeled walker, wherein the platform includes at least one platform wheel and a standing platform for a person using the walker; and an electric drive that is configured to move the wheeled walker forward in the driving direction, wherein the wheeled walker includes a coupling device that attaches the platform at the wheeled walker and transfers pull forces and push forces between the wheeled walker and the platform, wherein the coupling device is arranged in an intersection portion of a scissor linkage that is associated with the wheeled walker.

15 Claims, 15 Drawing Sheets

(56) References Cited

U.S. PATENT DOCUMENTS

| | | | | |
|---|---|---|---|---|
| 7,699,128 | B1 * | 4/2010 | Strauss | B62B 5/0026 180/23 |
| 8,006,786 | B1 * | 8/2011 | Chapman | A61G 5/1094 280/32.7 |
| 8,752,658 | B2 | 6/2014 | Kurek | |
| 9,744,095 | B1 * | 8/2017 | Mazzei | B62K 27/12 |
| 9,796,401 | B1 * | 10/2017 | Ammirati | B62B 5/0046 |
| 10,137,921 | B2 * | 11/2018 | Lee | B62B 5/004 |
| 10,285,894 | B1 * | 5/2019 | Haenel | A61H 3/04 |
| 10,286,977 | B1 * | 5/2019 | Haenel | B62K 11/007 |
| 11,186,342 | B2 * | 11/2021 | Day | B62D 65/10 |
| 2010/0193264 | A1 * | 8/2010 | Kurek | A61H 3/04 180/19.1 |
| 2013/0153322 | A1 | 6/2013 | Constin | |
| 2017/0165139 | A1 * | 6/2017 | Afshani | A61H 3/04 |
| 2017/0224575 | A1 * | 8/2017 | Donahue | B62B 1/14 |
| 2018/0148080 | A1 * | 5/2018 | Huizinga | B62B 1/12 |
| 2019/0151185 | A1 * | 5/2019 | Kirschey | A61H 3/04 |
| 2019/0290513 | A1 * | 9/2019 | Liang | A61G 5/1059 |
| 2020/0276075 | A1 * | 9/2020 | Kirschey | A61H 3/04 |
| 2022/0047445 | A1 * | 2/2022 | Van Varick | A61H 1/00 |

FOREIGN PATENT DOCUMENTS

| | | | |
|---|---|---|---|
| CN | 107021169 | A | 8/2017 |
| DE | 10355161 | A1 | 12/2004 |
| DE | 102005014613 | A1 | 10/2006 |
| DE | 202016002904 | | 10/2006 |
| DE | 202009009547 | U1 | 9/2009 |
| DE | 102007062406 | B4 | 4/2010 |
| DE | 202013007716 | | 9/2013 |
| DE | 102011106561 | | 10/2017 |
| EP | 2451423 | B1 | 7/2010 |
| WO | WO9916653 | | 4/1999 |
| WO | WO2011003392 | A1 | 1/2011 |

* cited by examiner

ELECTRICALLY DRIVEN WHEELED WALKER

RELATED APPLICATIONS

This application is a continuation of International application PCT/EP20181081514 filed on Nov. 16, 2018 claiming priority from German utility model application DE 20 2017 107 072.7 filed on Nov. 22, 2017 both of which are incorporated in their entirely by this reference.

FIELD OF THE INVENTION

The invention relates to a wheeled walker.

BACKGROUND OF THE INVENTION

Wheeled walkers serving as walking aides for humans with reduced mobility are well known in the art. They enable users to run every day errands. The wheeled walkers prevent persons with reduced mobility from falling and facilitate safely transporting loads like groceries. In particular people that need more assistance than a walking cane provides, however who's mobility that would be restricted excessively by a wheel chair experience a mobility improvement through the wheeled walker that exceeds the mobility improvement awarded by other walking aides.

Depending on their mobility restriction or application it can be very strenuous for people to travel with the wheeled walker. Several options for an electro motoric drive have been proposed in the art for these applications. Thus EP 2 451 423 B1 illustrates a walker with a trailing platform. The walker includes an electric drive. A user can stand on this platform and can put the drive in motion. The walker and the user are then propelled electrically. The platform disclosed in EP 2 451 423 B1 is raise able by an electric drive.

DE 10 2007 062 406 B4 also discloses an electrically driven wheeled walker. Also here a transport platform runs in trail wherein a separate drive wheel that provides propulsion at the wheeled walker.

DE 20 2013 007 716 U1 illustrates a trailing device for a baby carriage that is useable at a walker according to the description. The embodiment is characterized in particular in that a steer able guide wheel is arranged in a steering center of the composite that is made from the wheeled walker and the attached transport platform.

DE 20 2016 002 904 U1 discloses and electrically driven walker including a trailing device that is attached at an axis between the rear wheels of the wheeled walker.

Last not least DE 103 55 161 A1 and DE 10 2005 014 613 A1 disclose electrically driven trailing devices for baby carriages or shopping carts.

All these known devices have in common that a trailing device attached to the wheeled walker, baby carriage or shopping cart includes a standing surface for a person so that the person and the preceding auxiliary device (baby carriage, shopping cart, wheeled walker) is propelled by the electric drive.

Devices of this type are particularly helpful for humans with reduced mobility that have to climb up a slope are that are incapable of reaching a destination without stopping due to exhaustion unless they have electrical auxiliary propulsion.

The presented solutions are typically retro fits. Some of the trailing devices can be moved into a storage position or removed from the wheeled walker when they are not in use.

BRIEF SUMMARY OF THE INVENTION

Thus it is an object of the invention to provide an electrically driven walker that is safe to use.

The object is achieved by a wheeled walker including a front wheel pair viewed in a driving direction and a rear wheel pair viewed in the driving direction; a frame including rearward oriented struts, wherein each of the rearward oriented struts supports a rear wheel of the rear wheel pair; a platform attached at the wheeled walker, wherein the platform includes at least one platform wheel and a standing platform for a person using the walker; and an electric drive that is configured to move the wheeled walker forward in the driving direction, wherein the wheeled walker includes a coupling device that attaches the platform at the wheeled walker and transfers pull forces and push forces between the wheeled walker and the platform, wherein the coupling device is arranged in an intersection portion of a scissor linkage that is associated with the wheeled walker, or wherein the coupling device is part of a horizontal coupling rod that connects the rearward oriented struts that support the rear wheels, or wherein the coupling device is part of a horizontal coupling rod that connects the rear wheels or the rearward oriented struts wherein the horizontal coupling rod includes a folding joint wherein the coupling device is arranged in a portion of the folding joint.

Thus, the coupling device facilitates connecting the platform at the wheeled walker and disengaging the platform from the wheeled walker. Thus, the wheeled walker can be switched in a simple manner from motorized operations to non-motorized operations. Advantageously the coupling device is retro fit able at commercially available wheeled walkers and remains at the wheeled walker. The coupling device can be a coupling rod that is arranged between the struts that support the rear wheels, in particular when the wheeled walker is foldable parallel to an axis that extends transversal to the movement direction.

In wheeled walkers that are foldable along an axis that is parallel to the movement direction and which are typically configured with scissor levers the coupling device can also be configured as coupling rod. After unfolding the wheeled walker the coupling rod is inserted into the supports that are attached at the struts that support the rear wheels. These can be in particular coupling rod forks. Alternatively it is conceivable that the coupling device is configured as a bracket and attached in the portion of the intersecting scissor levers.

The coupling device can also be arranged at a link that is horizontally arranged between two lateral frame elements.

Particularly advantageously the standing surface of the platform is arranged between the wheels of the rear wheel pair.

Surprisingly the inventors have found that the trailing platform that is used for transporting the user is not well arranged from an ergonomic point of view in the art. In known wheeled walkers the trailing platform is behind a position of the user that is assumed during movement without propulsion.

Since the platform is arranged approximately where a user is located when the wheeled walker is operated without electrical propulsion the user can assume an upright ergonomically favourable body posture due to the platform arrangement according to the invention. By the same token the composite including the wheeled walker and the platform has much more tipping stability than the known devices due to the platform arrangement according to the invention in particular when the standing surface provided by the platform is completely or at least approximately with half its area in front of a geometric axis that runs through the rotation axes of the rear wheels.

The platform is configured with a backward tapering standing surface.

Thus it is provided in particular that the platform includes at least one wheel at a rear end wherein the wheel is advantageously configured as a drive wheel with an integrated electric motor.

A backward tapering platform in particular with a backward tapering standing surface and a single wheel centrally arranged at a rear end of the platform, in particular a drive wheel provides good support for the platform due to the drive wheel being arranged in the rear. The rear drive wheel is provided with high surface pressure due to the physical forces so that the risk of wheel slippage is minimized. Thus, the backward tapering standing surface corresponds to an approximately trapezoid contact surface of the feet of the standing person. The invention utilizes this fact in that it adapts the platform to this standing surface by providing the platform with a backward taper. Additional usable space is provided between the rear wheels of the wheeled walker in particular when going around turns which facilitates tighter turn radii.

The platform carries an accumulator to provide power to the electric motor, wherein the accumulator is arranged in particular at a bottom side of the platform or in a receiving recess on the top side of the platform.

An advantageous embodiment provides that all essential electric drive components in addition to the accumulator, e.g. the drive controls and optional charging electronics for the accumulator are arranged at the platform. It is overall advantageous for the center of gravity of the platform and the composite when the accumulator is arranged below the platform. It is conceivable to provide a compartment or a drawer at this location so that the accumulator can be retrieved for charging. It is also conceivable to permanently install the accumulator at this location and to provide the accumulator with a charge plug. In this case the platform has to be moved close to a power outlet in order to charge the accumulator. An accumulator that is arranged below the platform has the advantage that the standing surface formed on the top side of the platform is maximized.

In order to facilitate retrieval or replacement of the accumulator it is conceivable to provide a recess or a support on the platform to receive the accumulator. The recess or support can also provide installation space for control and electronic components. This shaft or the support is ideally oriented along a longitudinal axis of the platform that is arranged in the driving direction and divides the platform into two standing surface halves so that the recess is arranged between the feet of the user when the platform is being used.

When all components that are required for electrical driving are integrated into the platform these components are removed from the wheeled walker when the platform is removed so that the wheeled walker can be switched from motor driven operations to non-motor driven operations in one step.

An operating handle for adjusting the propulsion speed of the wheeled walker, e.g. a twist grip can be connected with the control arranged on the platform via radio link. In case wires are run from the operating handle to the control this hard wire connection is separable in the portion of a coupling device between the platform and the wheeled walker, in particular by a disengageable plug connection. A radio link via blue tooth is advantageous. According to the invention the coupling device includes a link which facilitates relative pitch movements between the wheeled walker and the platform and that defines a rotation axis between the wheeled walker and the platform wherein the composite including the wheeled walker and the platform kinks about the rotation axis when driving through a turn.

Thus, it is provided that the coupling device includes at least two rotation axes, a first axis runs transversal to the movement direction. A second axis runs essentially orthogonal to the platform surface. Thus, the axis oriented transversal to the movement direction compensates for pitch movements. The vertical axis serves as a rotation axis and the composite bends around the rotation axis when driving through a turn. There is no relative movement between wheeled walker and platform about a longitudinal axis of the wheeled walker. The connection is torque proof about this axis.

The coupling device is furthermore provided with a horizontal axis that facilitates moving the platform from a functional position where the platform is in use into a storage position.

Thus, it is provided in particular that the horizontal axis that is used for moving the platform between the functional position and the storage position coincides with the axis that compensates for the pitch movements.

It is furthermore provided that the platform is arranged below the coupling device in its functional position and supported in the coupling device by a vertical strut.

Particularly advantageously the coupling device includes a thrust receiver that receives the vertical strut wherein the vertical strut is supported in the thrust receiver so that the vertical strut is movable in a linear manner relative to the thrust receiver.

The thrust receiver facilitates to move the platform in its storage position in a direction towards the front wheels of the wheeled walker and thus keep the space between the rear wheels clear to provide movement space for the user.

The coupling device furthermore includes a lift assist that supports a movement of the platform from a functional position into a storage position, in particular a mechanical lift assist like e.g. a lift spring.

Alternatively the lift assist can also be provided with an electric motor.

Alternatively the wheel is provided with a protective device that is rotatable about a wheel axis wherein the protective device is oriented towards the user of the wheeled walker in the storage position and covers the running surface of the wheel that is oriented towards the user.

The protective device is provided as a fender that envelops the wheel and has two functions. On the one hand side it protects the user against a contact with the drive wheel when using the electric drive and thus helps to prevent accidents.

However, when the platform is in a storage position thus folded up the fender is rotate able about the wheel axis so that the fender is oriented towards the user of the wheeled walker. Thus, the fender covers the running surface of the drive wheel that is oriented towards the user and protects against contaminant particles that adhere to the drive wheel.

It is furthermore provided that the platform trails within a surface that is laterally defined by radial planes of the rear wheels when driving through a turn.

This embodiment according to the invention achieves a very high level of tipping stability of the composite including the wheeled walker and the platform.

Further improvement of stability is achieved when the contact surface of the user is arranged on the platform essentially within a triangle that is formed by the rear wheels of the wheeled walker and by the wheel of the platform. The platform is disengageable from the coupling device.

It is furthermore provided that the platform is foldable along a longitudinal axis that is parallel to the driving direction.

The essential advantage of the foldable platform is improved transport ability and store ability.

The object is also achieved by a wheeled walker with the features of independent claim 15, in particular it characterizing features according to which the platform and the wheeled walker include a common coupling device wherein the coupling device is arranged between a geometric rotation axis of the rear wheels and a geometric rotation axis of the front wheels.

Due to the arrangement of the coupling device between the front axle and the rear axle of the wheeled walker the weight of the user that stands on the platform also loads the front axle. This effectively prevents a lifting of the front wheels from the ground in particular when running uphill or running over obstacles like curbs. The additional loads on the front wheels of the wheeled walker improves driving stability of the wheeled walker also when running on level ground compared to coupling arrangements at or behind the geometric rear axis since a partial load from the user impacts the front wheels as well as the rear wheels of the wheeled walker.

BRIEF DESCRIPTION OF THE DRAWINGS

Further advantages can be derived from the subsequent description of advantageous embodiment with reference to drawing figures, wherein:

FIG. 4 A illustrates the platform according to FIG. 4 with a coupling device lifted off from the support mandrel;

DETAILED DESCRIPTION OF THE INVENTION

Figure 1:
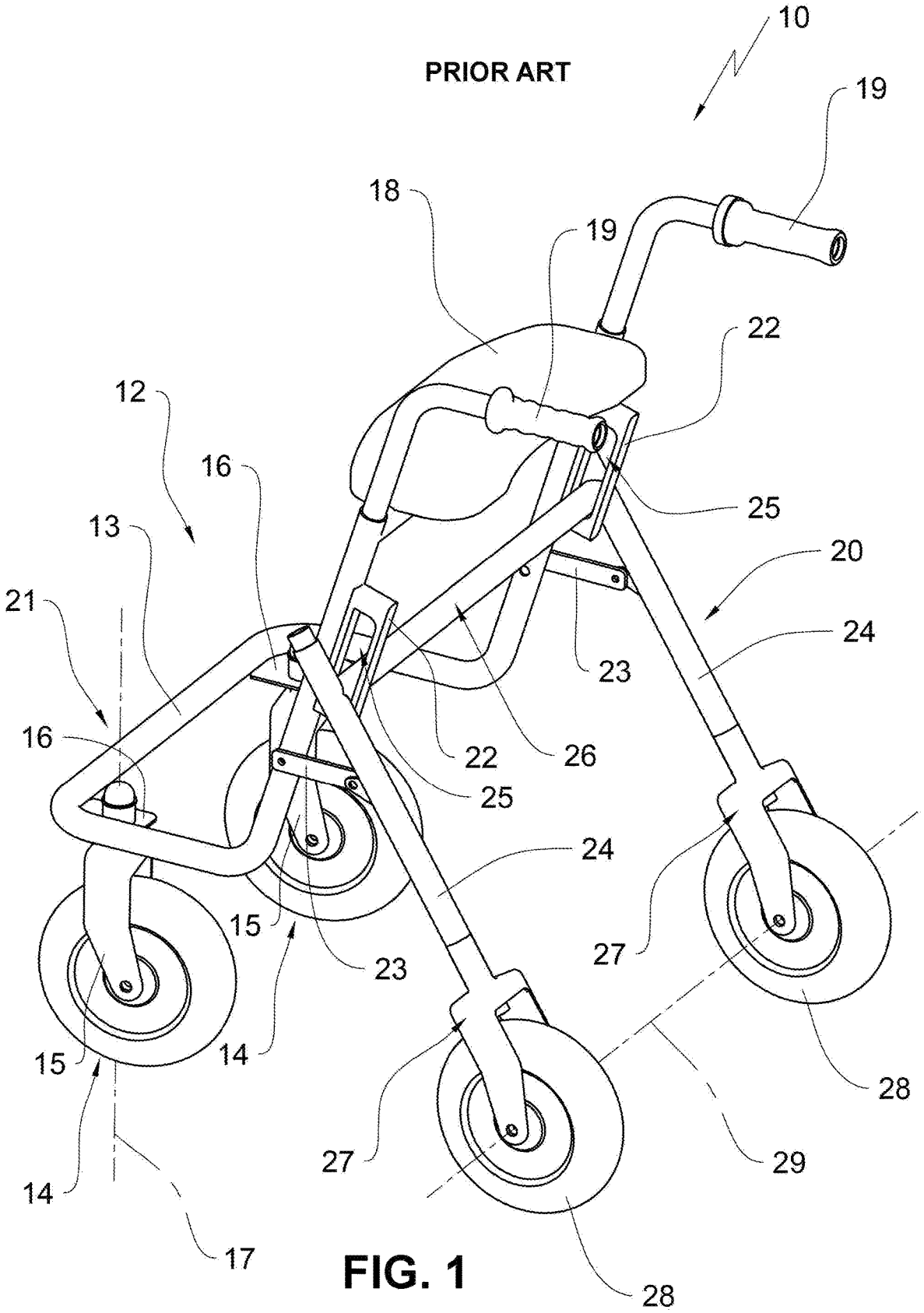
FIG. 1 illustrates a prior art wheeled walker.
Figure 2:
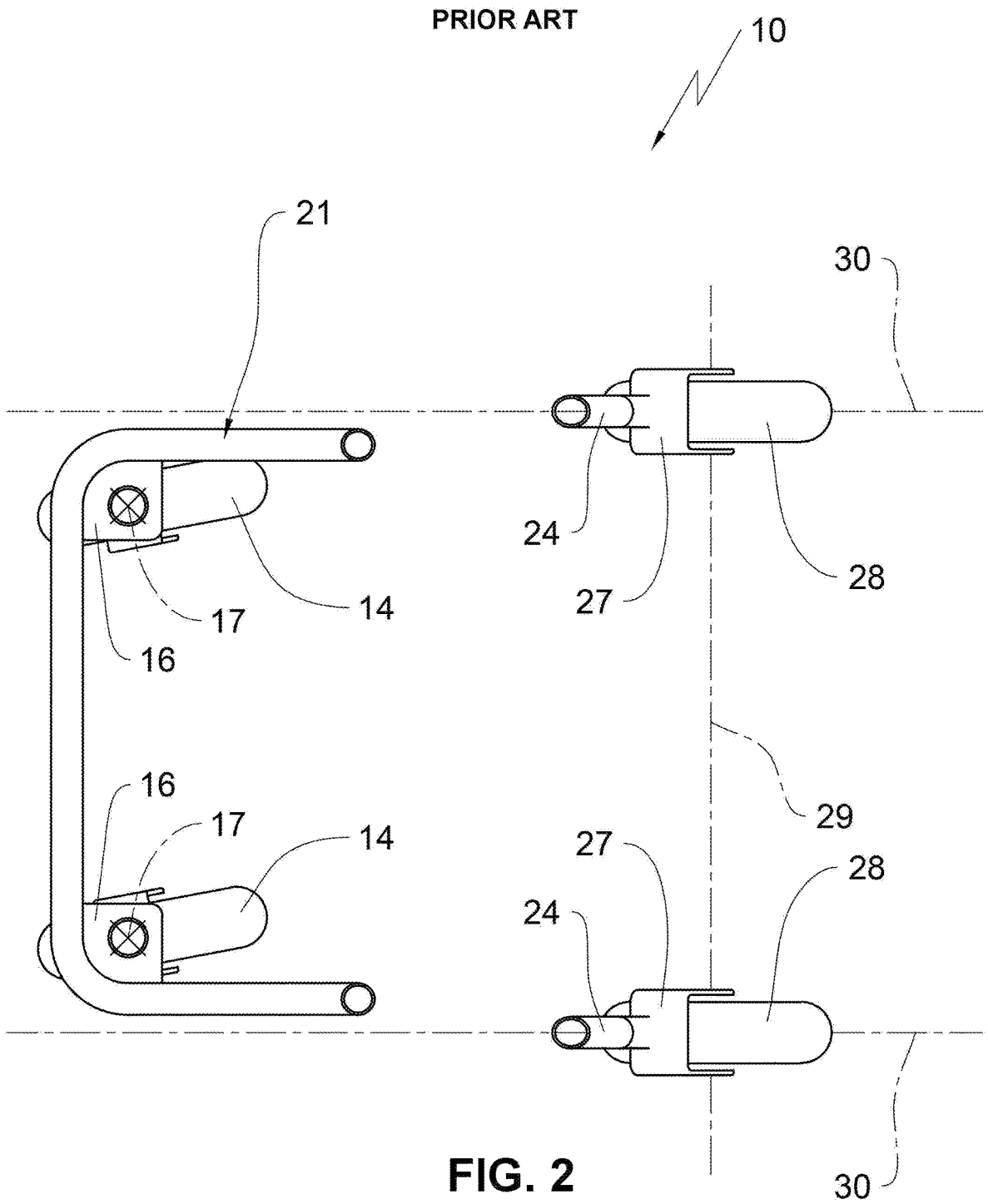
FIG. 2 illustrates a horizontal sectional view of the wheeled walker according to FIG. 1.

A wheeled walker is designated overall with reference numeral 10 in the drawing figures. FIGS. 1 and 2 illustrate a known wheeled walker 10 which is improved in various embodiments in the subsequent drawing figures and supplemented by a trailing platform 11 to form a wheeled walker 10 according to the invention. Thus, unless stated differently the general description of the known walker also applies for the walker according to the invention. Therefore identical reference numerals are used for analogous or equivalent components.

FIG. 1 illustrates the known wheeled walker 10 in a perspective view. The wheeled walker 10 includes a frame that is overall designated with reference numeral 12 and made with a tubular rod arrangement 13 which is used for attaching various components. The frame 12 has two components, thus a forward frame section 21 and a rear frame section 20. The frame 12 with its forward frame section 21 supports two front wheels 14 that are arranged adjacent to one another and that are respectively supported by a forward wheel fork 15. Thus, the forward wheel forks 15 are arranged in a wheel fork support 16 so that they are pivotable about a vertical rotation axis 17 at the frame.

The frame 12 supports a seating or support board 18 and two support handles 19 which are supported in the tubular rod arrangement of the frame 12 in a telescoping manner in order to facilitate continuous elevation adjustment and thus an adaptation to the height of the user. In a wheeled walker 10 according to the invention at least one of the handles 19 is configured as a twist handle wherein rotating the twist handle feeds electricity to a motor. Increasing the twist angle of the handle 19 increases the speed of the motor. The twist handle automatically goes back into a zero position when the operator lets go. Propulsion by the motor is stopped in the zero position.

The rear frame section 20 is attached at the front frame section 21 via two support elements 22 with slotted holes and two bell crank levers 23.

The rear frame section 20 includes two struts 24 that are oriented parallel to each other and that are coupled with each other by a horizontal connecting rod 26 that is supported in the support elements 22 or its slotted holes 25. Each bell crank lever 23 connects a respective strut 24 with the front frame section 21.

Each strut supports a rear wheel fork 27 wherein each wheel fork 27 supports a rear wheel 28. An imaginary rear axle 29 that connects the wheels runs geometrically through the rotation axes of the rear wheels 28. Thus, the rear wheels 28 are fixed in the rear wheel forks 27, this means they are not pivotable.

The wheeled walker illustrated in FIG. 1 is collapsible by moving the horizontal connecting rod upward in the slotted hole, wherein the bell crank lever joints 23 are folded.

FIG. 2 illustrates the wheeled walker according to FIG. 1 in a vertical sectional view. The sectional plane is arranged slightly above the rear wheel forks 27. FIG. 2 illustrates in particular the pivotable support of the rear wheels 14 in the rear wheel supports 16. FIG. 2 also illustrates the geometric rear axis 29 which is relevant for the subsequent drawing description and the radial plane 30 defined by each rear wheel 28.

Figure 3:
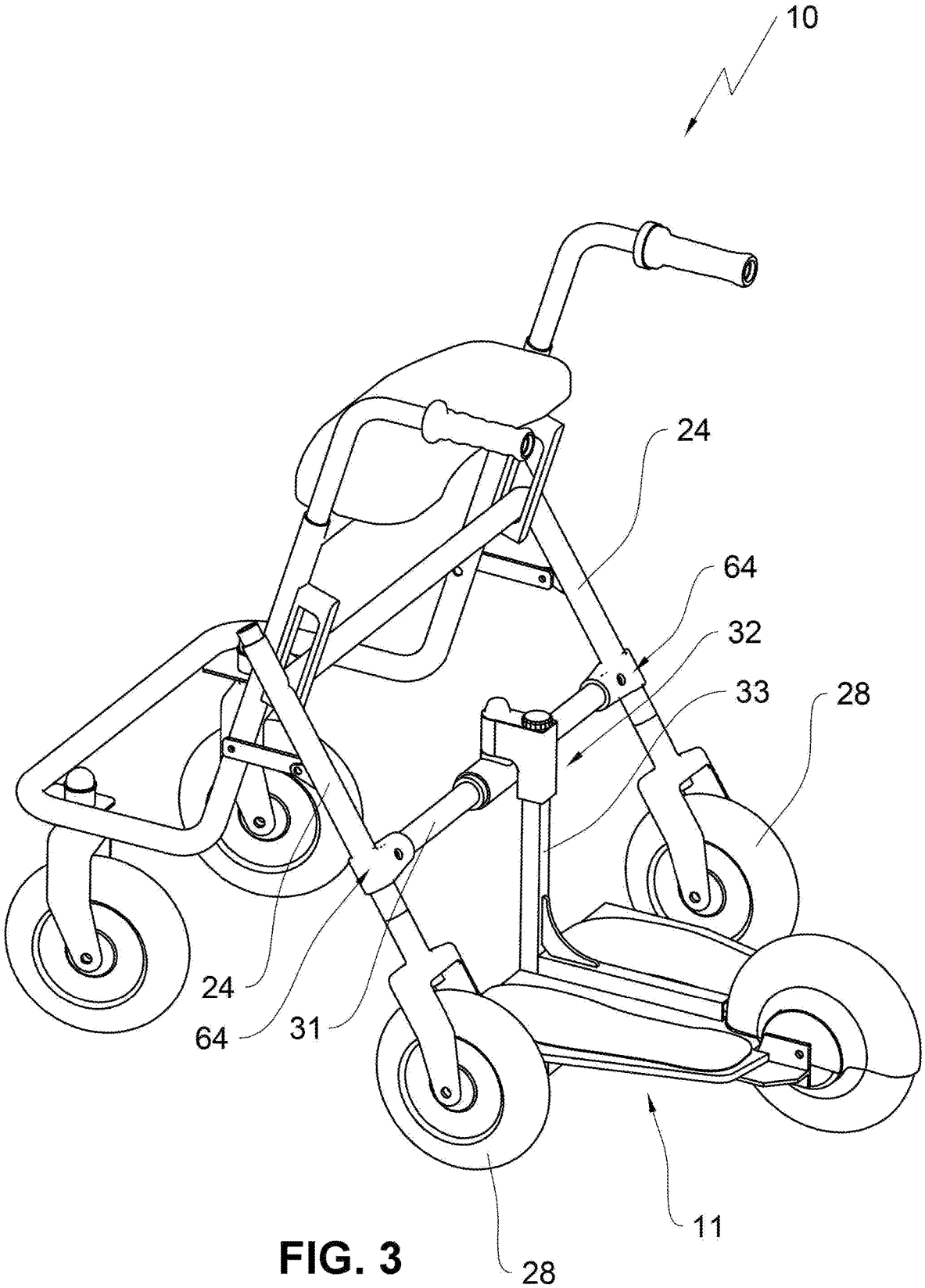
FIG. 3 illustrates a first embodiment of a wheeled walker according to the invention with an attached platform.

FIG. 3 illustrates a wheeled walker 10 according to the invention. The wheeled walker 10 according to the invention is in some respects similar to the known walker of FIGS. 1 and 2, but supplemented according to the invention with the trailing platform 11. Thus, the invention uses a coupling rod 31 that is oriented horizontal or parallel to the horizontal connecting rod 26 and connects the rear struts 24 which support the rear wheels 28 with one another. The coupling rod 31 is attached at the rear struts 24 by two clamps 64.

The actual coupling device 32 is attached at the coupling rod 31 wherein a vertical strut 33 is supported in the coupling device and establishes a connection between the platform 11 and the coupling device 32. The trailing platform 11 is arranged with its standing surface between the rear wheels 28 so that the user assumes a similar position on the platform 11 relative to the handles 19 like when using the wheeled walker without the platform 11. Compared to known solutions the user of the platform 11 assumes a particularly ergonomical position. Tipping stability of the composite including the wheeled walker 10 and the platform 11 is increased significantly when driving around a turn since all 14 wheels of the wheeled walker are loaded.

Arranging the coupling device between the imaginary geometric rotation axis of the front wheels 14 and an imaginary geometric axis of the rear wheels 28 stabilizes the wheeled walker 10 also when driving straight ahead. The weight force of the user can also be applied to the front wheels 14 which mitigates a risk of the front wheels 14 losing ground contact.

Figure 4:
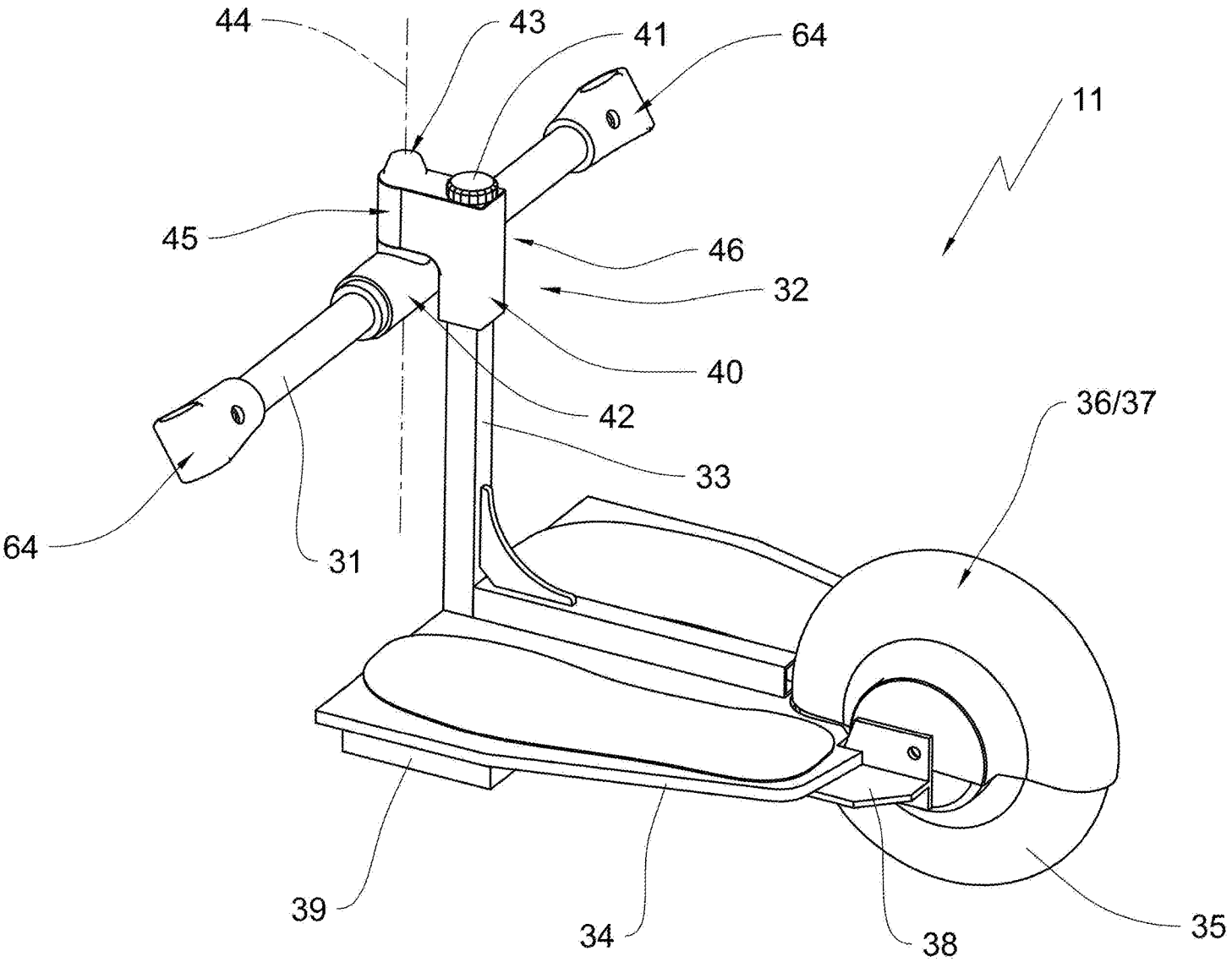
FIG. 4 illustrates the platform according to FIG. 3 by itself.
Figure 5:
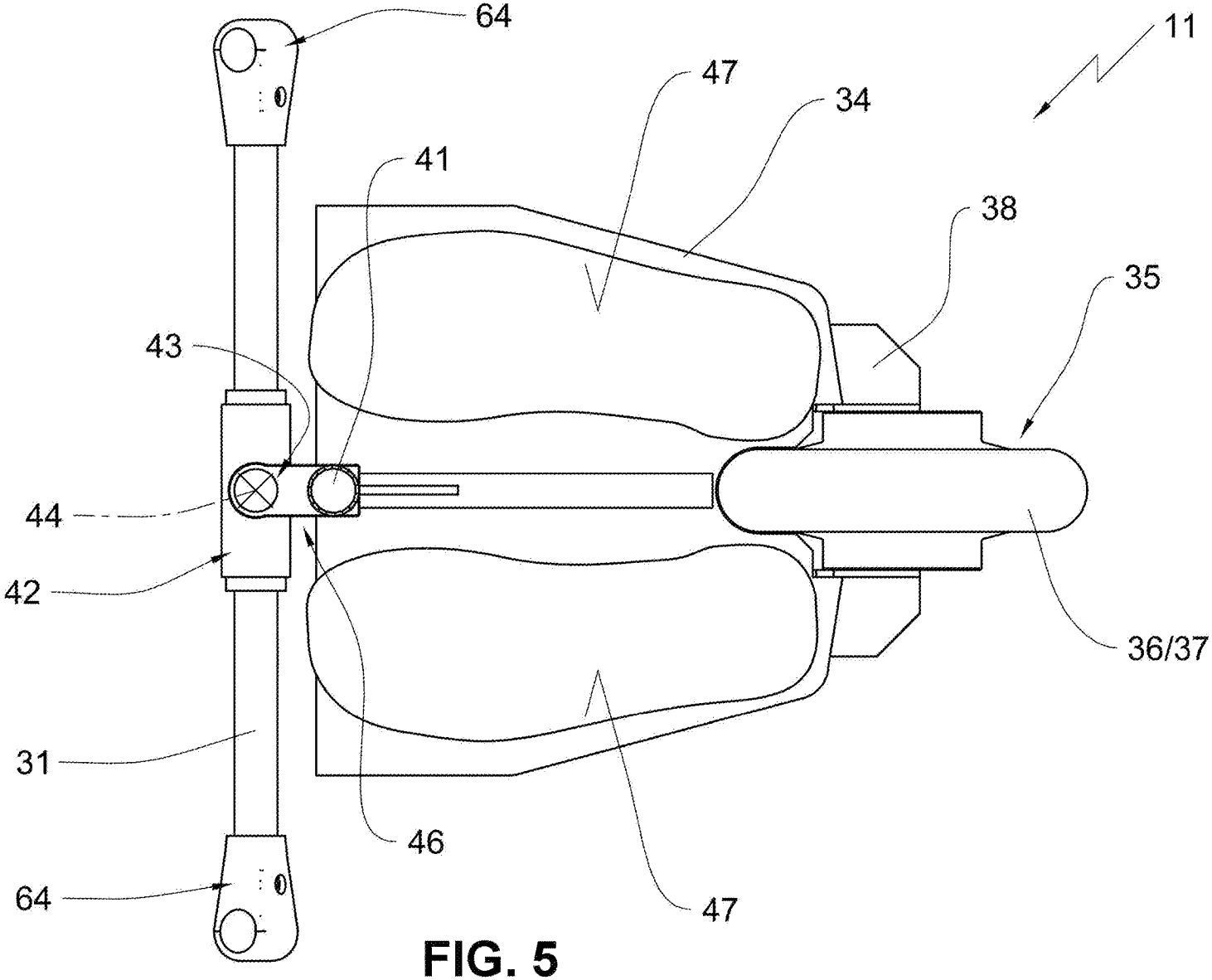
FIG. 5 illustrates the platform according to FIG. 4 in a top view.
Figure 6:
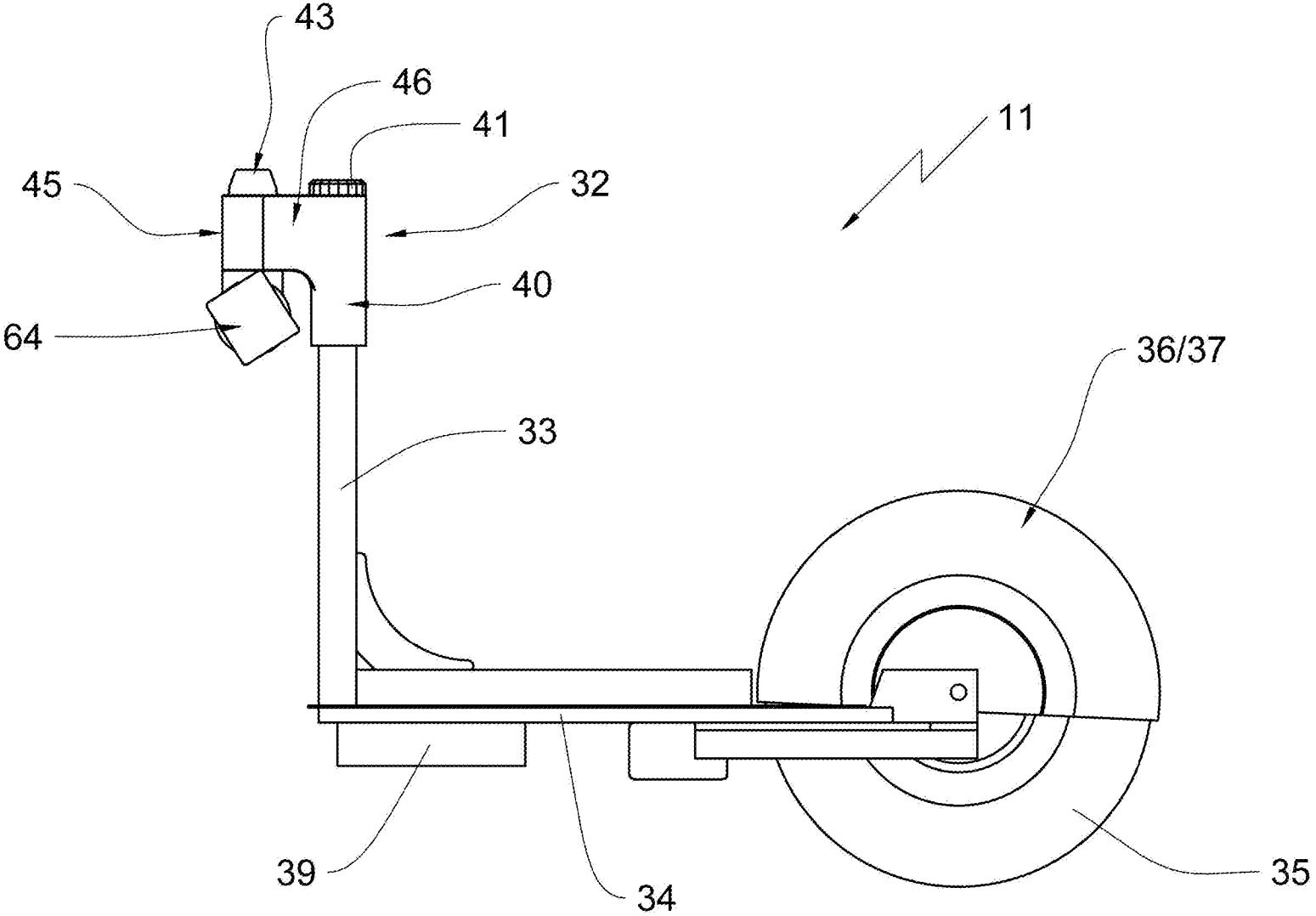
FIG. 6 illustrates the platform according to FIG. 4 in a side view.

The trailing platform 11 with the coupling rod 31 and the coupling device 32 is illustrated by itself in FIGS. 4-6. The trailing platform 11 includes a board 34 which can be made from wood but also from fiber reinforced synthetic material, in particular poly carbonate or polyimide but also can be made from other materials.

The platform wheel 35 is arranged at the end of the board 34 that is oriented away from the coupling device 32 wherein the platform wheel is at least partially covered by a protective device 36 configured as a fender 37. A platform wheel fork 38 attaches the platform wheel 35 at the board 34.

In an advantageous embodiment of the invention an electric motor is integrated into the platform wheel 35 so that the drive unit for the wheeled walker according to the invention is formed by the platform wheel itself. The motor is provided with a break function which prevents the wheeled walker from accelerating when going downhill. Advantageously the speed of the motor is always proportional to a position of the twist handle 19 when voltage is applied. Idle can be implemented by a no power condition or by a separate circuit that allows moving the wheeled walker including the platform by hand.

In an advantageous embodiment the maximum speed of the composite including the wheeled walker 10 and the platform 11 can be preselected. This can be helpful in particular for inexperienced users learning to operate the wheeled walker.

A flat accumulator 39 is arranged at a bottom side of the board 34 and stores electrical propulsion energy for the motor driven platform wheel. Ideally the accumulator 39 is arranged in a shaft that is arranged at a bottom side of the board 34 which can also house the control electronics. The accumulator 39 can be remove able from the shaft for charging. However, when the accumulator 39 is fixed at the board 34 in a different embodiment charging contacts are provided to supply the accumulator with electricity.

Arranging the drive wheel 35 at the rear end of the platform 11 helps stability of the composite including the wheeled walker 10 and the platform 11 since the load of the user impacts at the coupling arrangement 32 with the platform wheel 35. Additionally the ground pressure of the platform wheel 35 can be maximized which prevents possible slippage.

The coupling device 32 includes a thrust receiver 40 to connect the vertical strut 33. The vertical strut 33 is displaceable in the thrust receiver as will be described infra. In order to provide a movement end stop of the vertical strut 33 that is arranged displace able in the thrust receiver 40 in the functional position of the platform 11, the vertical strut 33 is provided with a retaining bolt 41 at a face of the vertical strut 33. The retaining bolt can be disengaged to separate the platform and the coupling device from the face of the vertical strut so that the vertical strut 33 is remove able from the thrust receiver 44. Furthermore fine adjustment of a platform inclination can be performed by the retaining bolt 41.

Figure 4A:
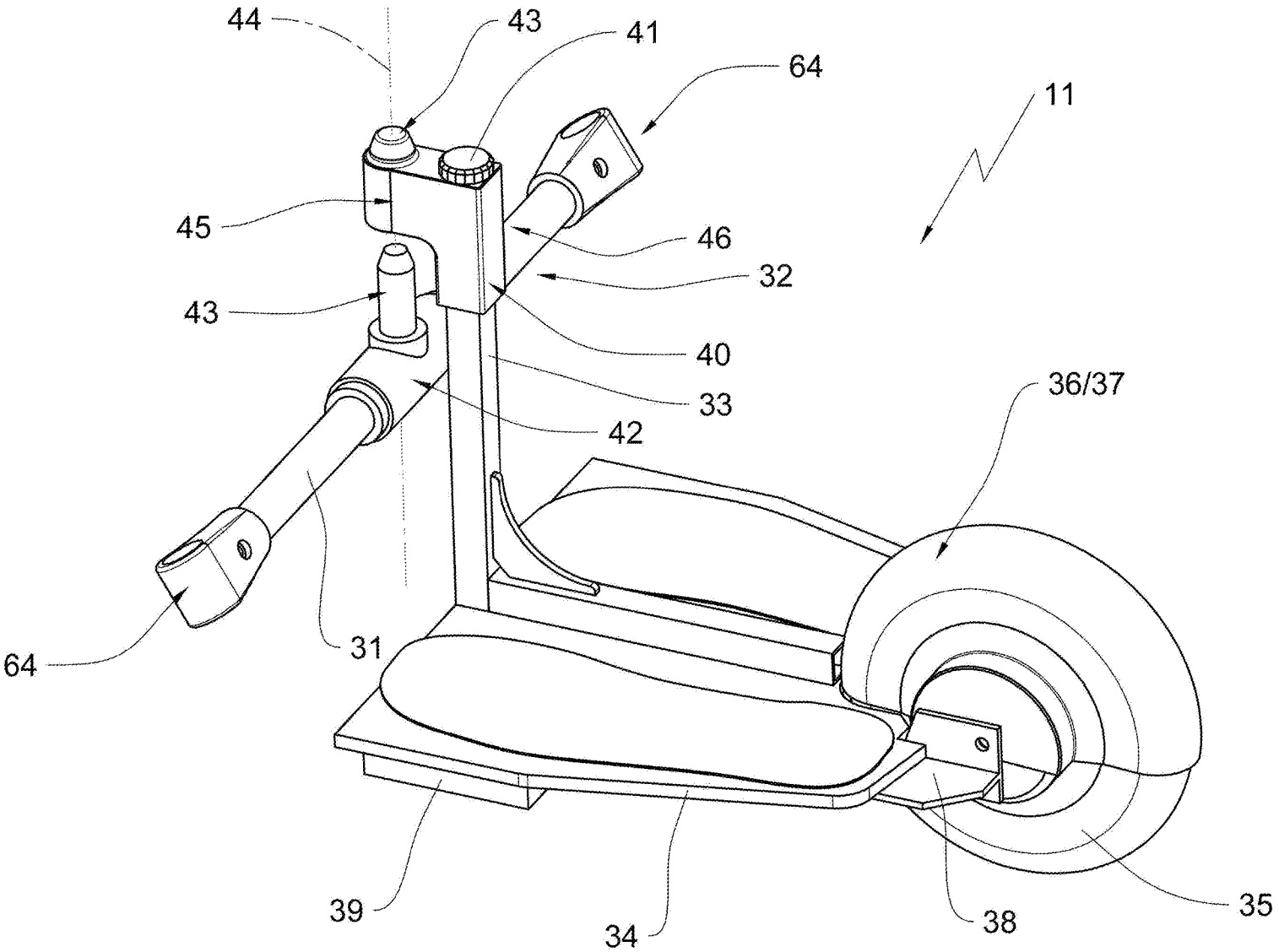

In order to separate the composite including the wheeled walker 10 and the platform 11 the coupling device 32 is lifted off from the support mandrel 43 as illustrated in FIG. 4A. Thus, initially a non-illustrated safety element is removed which prevents unintentional disengagement of the support mandrel 43 and the coupling device 32. In case there is a hard wired connection between the platform 11 and the wheeled walker 10 a plug connection has to be disengaged that is advantageously arranged in a portion of the coupling device 32. The safety element which normally secures the connection between the coupling device 32 and the support mandrel 43 can be used to prevent the support mandrel 43 against tilting out of the vertical. This can be useful in particular when the support mandrel 43 is force loaded to support a displacement of the platform 11 as will be described infra Among other things the coupling device is used to compensate for a pitch movement of the composite formed by the wheeled walker 10 and the platform 11 in order to define a rotation axis between the wheeled walker 10 and platform 11 wherein the composite kinks about the rotation axis when driving around a turn. In order to compensate pitch movement the coupling device 32 includes a horizontal sleeve section 42 that is rotate ably supported on the coupling rod 31. The sleeve section 42 includes a vertically oriented support mandrel 43 that forms the vertical rotation axis 44 of the coupling device 32 and that is formed by a support sleeve 45 of a support arm 46 that forms the thrust receiver 40 (c.f. FIG. 4A).

As evident in particular from FIG. 5 that illustrates a top view of the platform 11 the board 34 of the platform 11 is tapered backward in a direction towards the platform wheel 35 and has an approximately trapezoid cross section. Thus, the board approximately supports a contour of the natural standing surface of a human. The surfaces 47 symbolize feet standing on the board 34. The essential advantage of the trapezoid configuration of the board 34 or of the trapezoid board section is in particular that more space if provided for the platform 11 between the rear wheels 28 when driving around turns with the wheeled walker 10 according to the invention. Also when using only one platform wheel 35 at the platform end as illustrated in the embodiments helps to optimize the movement space between the rear wheels 28 of the wheeled walker 10 that is provided for driving around turns. Alternatively two twin wheels that are arranged directly adjacent to each other at the platform end can be used.

As recited in the brief summary of the invention and in the patent claims the platform 11 can be moved from a functional position contacting the floor into a storage position. This is illustrated in FIGS. 7 and 8.

In order to be moved from the functional position into the storage position the platform 11 is raised and the wheel is brought approximately to the elevation of the seat or support board 18. This corresponds to a pivot movement of approximately 90°. In other embodiments the pivot movement can exceed the 90° angle so that the platform wheel 35 contacts the support board 18. This is advantageous for supporting the wheel in the storage position since the center of gravity is optimized.

When moving the platform 11 into the storage position it, is moved towards the front wheels 14 by moving the vertical strut 33 in the thrust receiver 40 of the coupling device 32 in a direction towards the front wheels 14. This way the platform 11 is moved out of a movement range of a user using the wheeled walker when the platform 11 is in its storage position. Therefore the wheeled walker 10 can be used without limitation when the platform 11 is in the storage position. In particular sufficient knee clearance is provided so that walking can be performed with the wheeled walker without restrictions.

Figure 7:
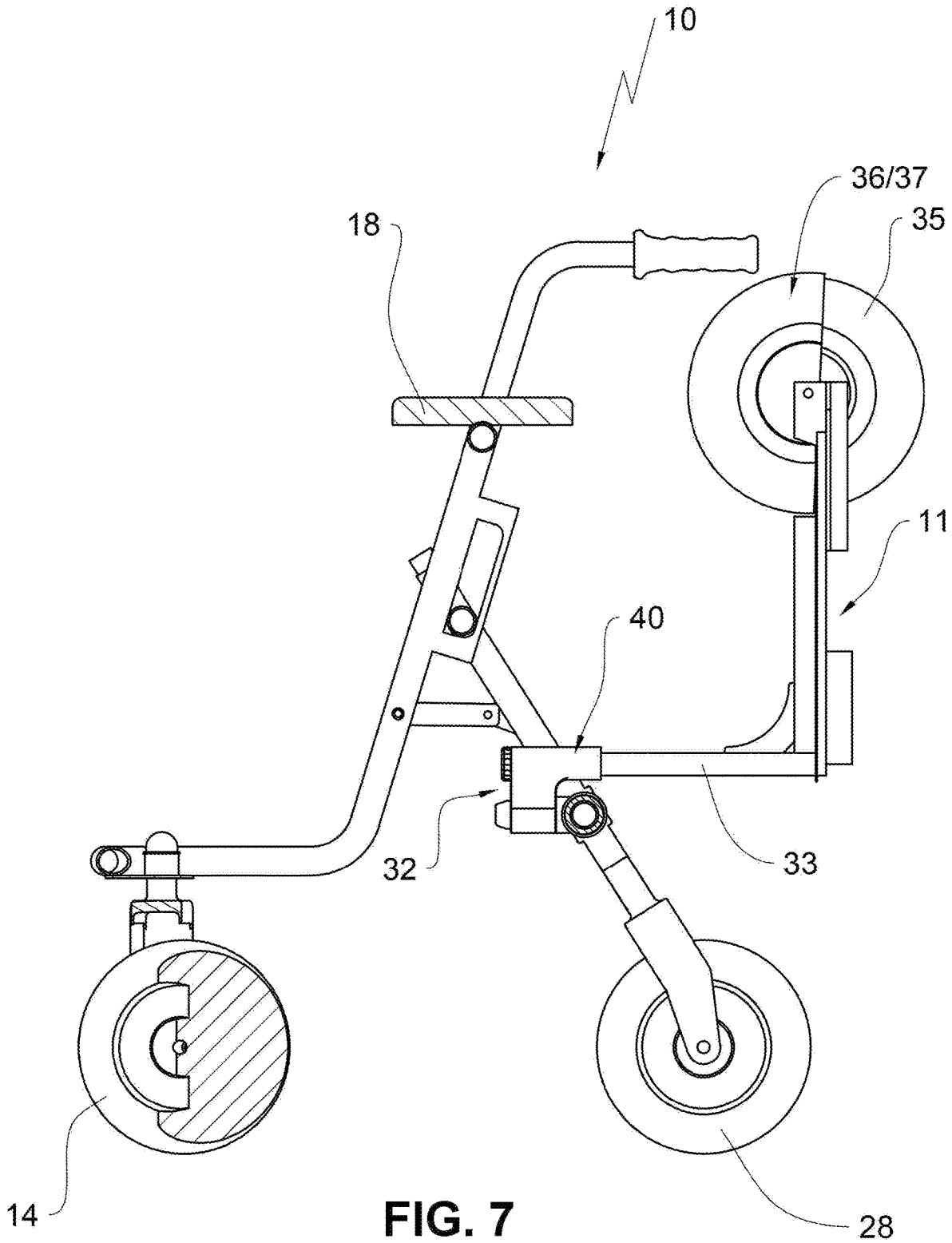
FIG. 7 illustrates the wheeled walker according to FIG. 3 in a vertical sectional view with the platform raised.
Figure 8:
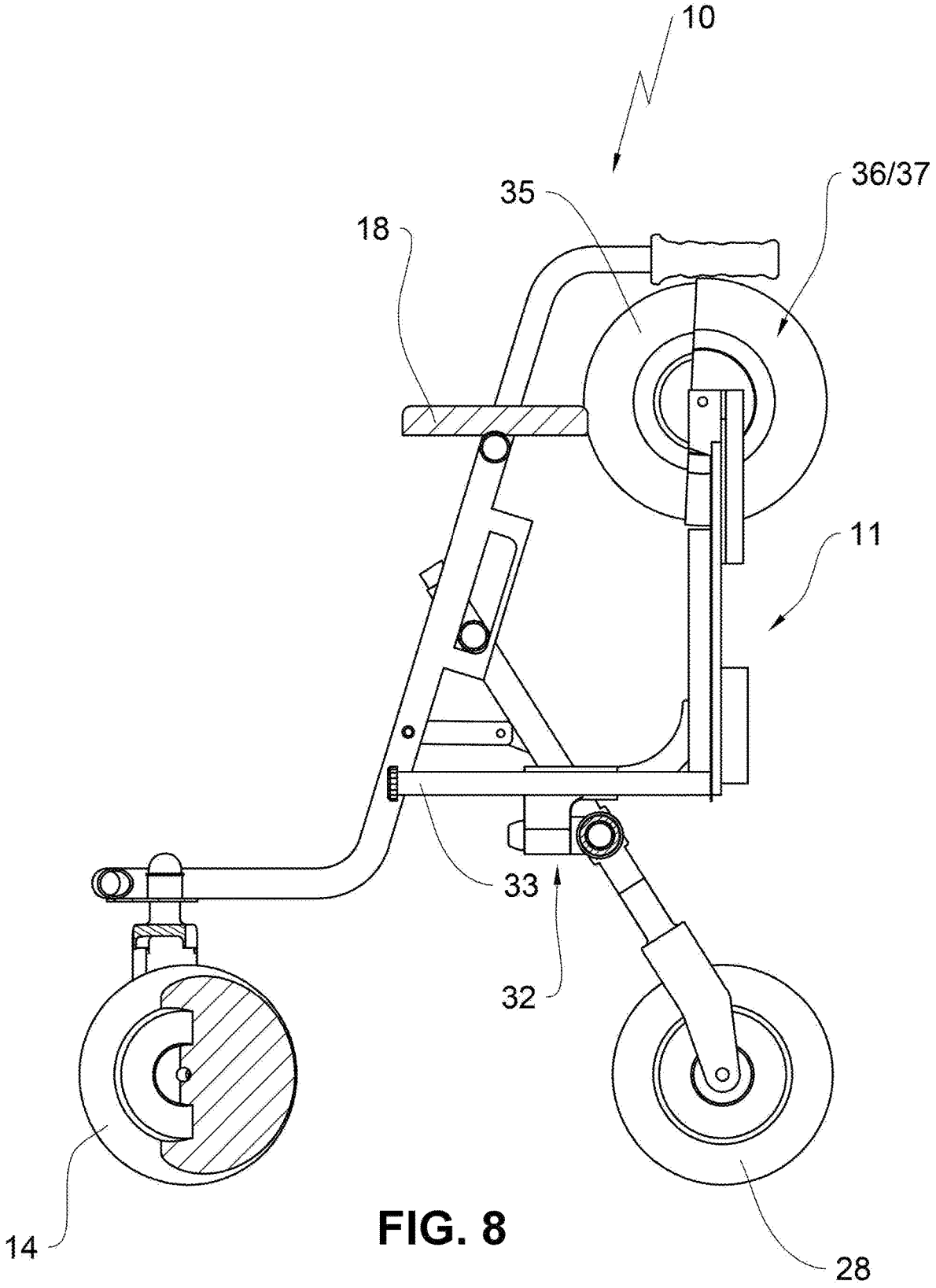
FIG. 8 illustrates the embodiment according to FIG. 7 with the platform in storage position.

As evident in particular from a comparison of FIGS. 7 and 8 the orientation of the protective device 36 is changed. The protective device 36 or the fender 37 is arranged pivotable about the wheel axis. Thus the protective device can be rotated by about 180° about the platform wheel 35 when the platform 11 is in the storage position so that the protective device is oriented towards the user of the wheeled walker 10. This way the platform wheel 35 is covered and the user the wheeled walker is protected against contaminant particles adhering to the platform wheel 35.

In order facilitate moving the platform 11 between a functional position and a storage position the coupling device 32 has a pivot axis. In the embodiment the pivot axis coincides with the coupling rod 31 so that the axis that compensates the pitch movements of the composites coincides with the horizontal pivot axis for displacing the platform 11 between the functional position and the storage position.

In order to support the pivot movement from the functional position into the storage position support by an electric motor or mechanical support can be provided. A mechanical support is provided in particular using e.g. a torsion spring that is arranged on the coupling rod 31. The pivot movement can also be supported by a gas pressure spring.

The platform 11 can be supported by interlocking elements in its storage position wherein the interlocking elements are e.g. interlocking balls that are arranged in an intermediary space between the coupling rod 31 and the sleeve section 42. Additionally a retaining belt or a magnet can be provided that secures the platform 11 in the storage position.

Figure 9:
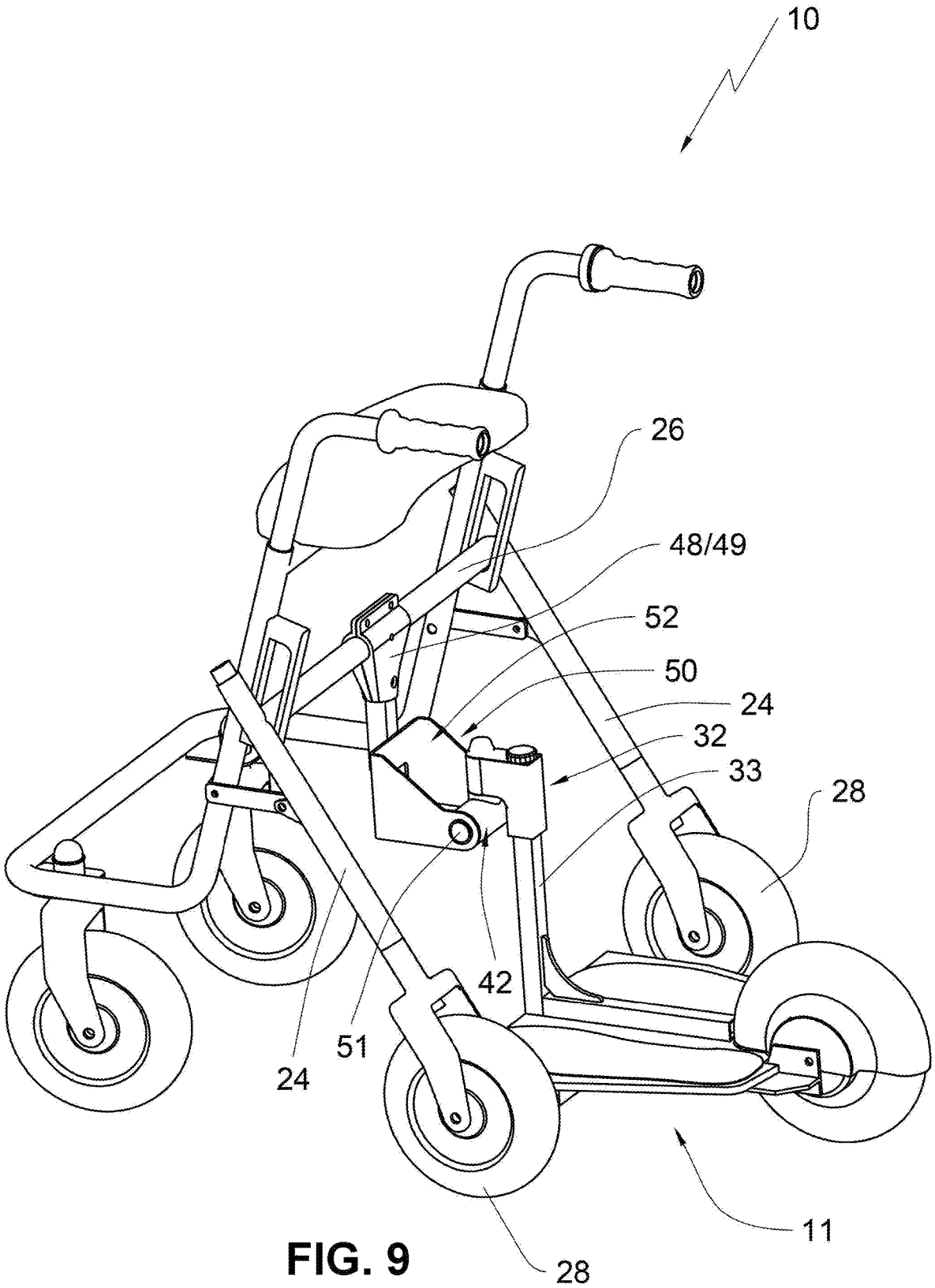
FIG. 9 illustrates the wheeled walker according to FIG. 3 with an alternative platform attachment at an existing transversal rod.

FIG. 9 illustrates another embodiment of the invention further improving upon the wheeled walker described supra. The horizontal connecting rod 26 is used to fix the platform 11 at the wheeled walker 10 wherein the connecting rod 26 arranges the support struts 24 at each other that support the rear wheels 28. Thus a suitable fastener 48 in particular a clamping device 49 is used to attach a coupling basket at the wheeled walker 10. The coupling basket 50 supports the coupling device 52 that is configured as described supra. The coupling basket 50 itself forms an axle element 51 wherein the sleeve section 42 of the coupling device 32 is supported about the axle element.

The coupling basket 50 includes a thrust recess 52 wherein the vertical strut of the platform is insertable through the thrust recess when the platform 11 is arranged in its storage position. Then the coupling basket 50 is used simultaneously to support the platform 11 in its storage position in that the vertical strut 33 is supported at edges of the thrust receiver 52 so that a return of the platform 11 into the functional position is blocked.

Figure 10:
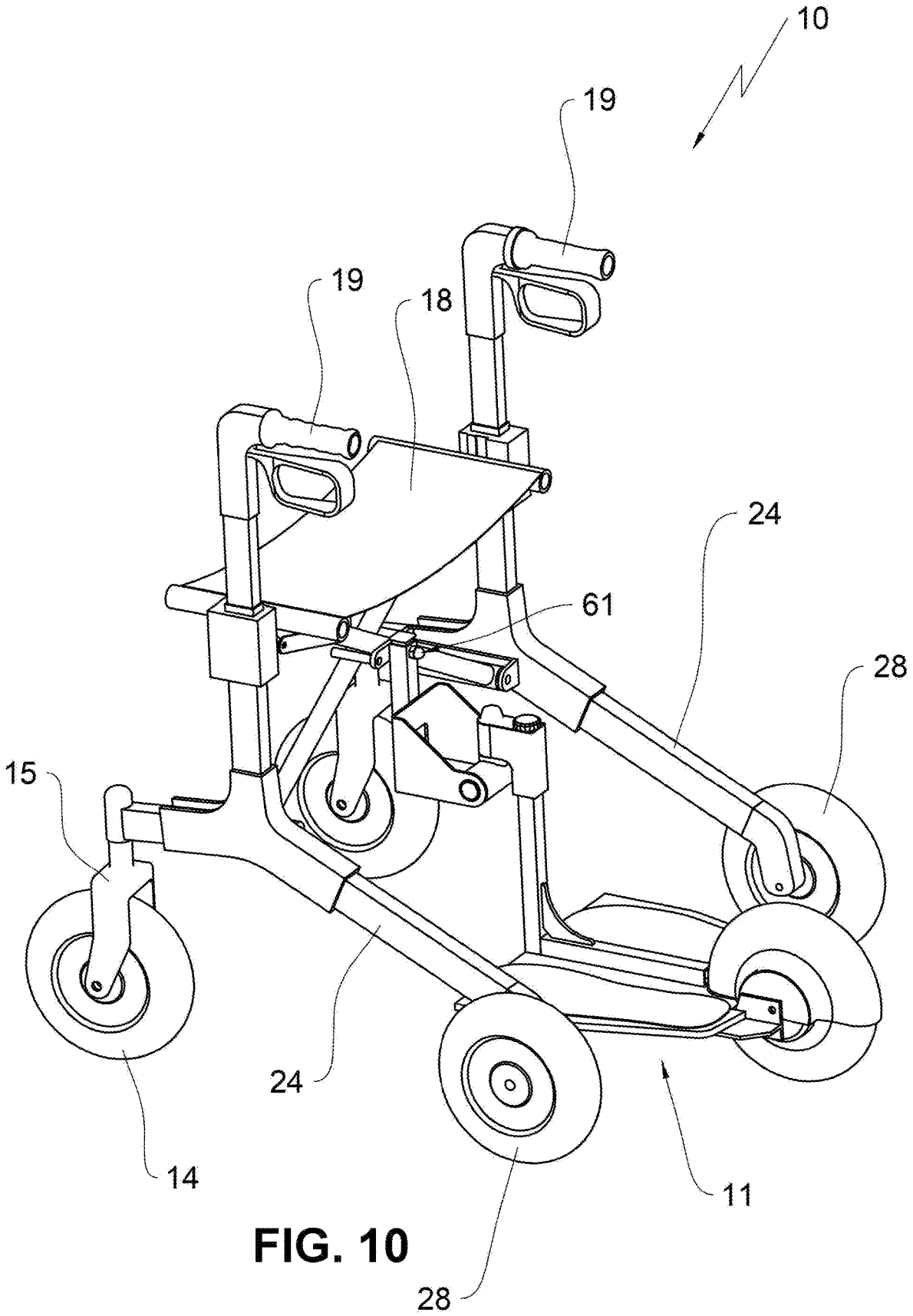
FIG. 10 illustrates a wheeled walker according to the invention in a second embodiment together with the platform.
Figure 11:
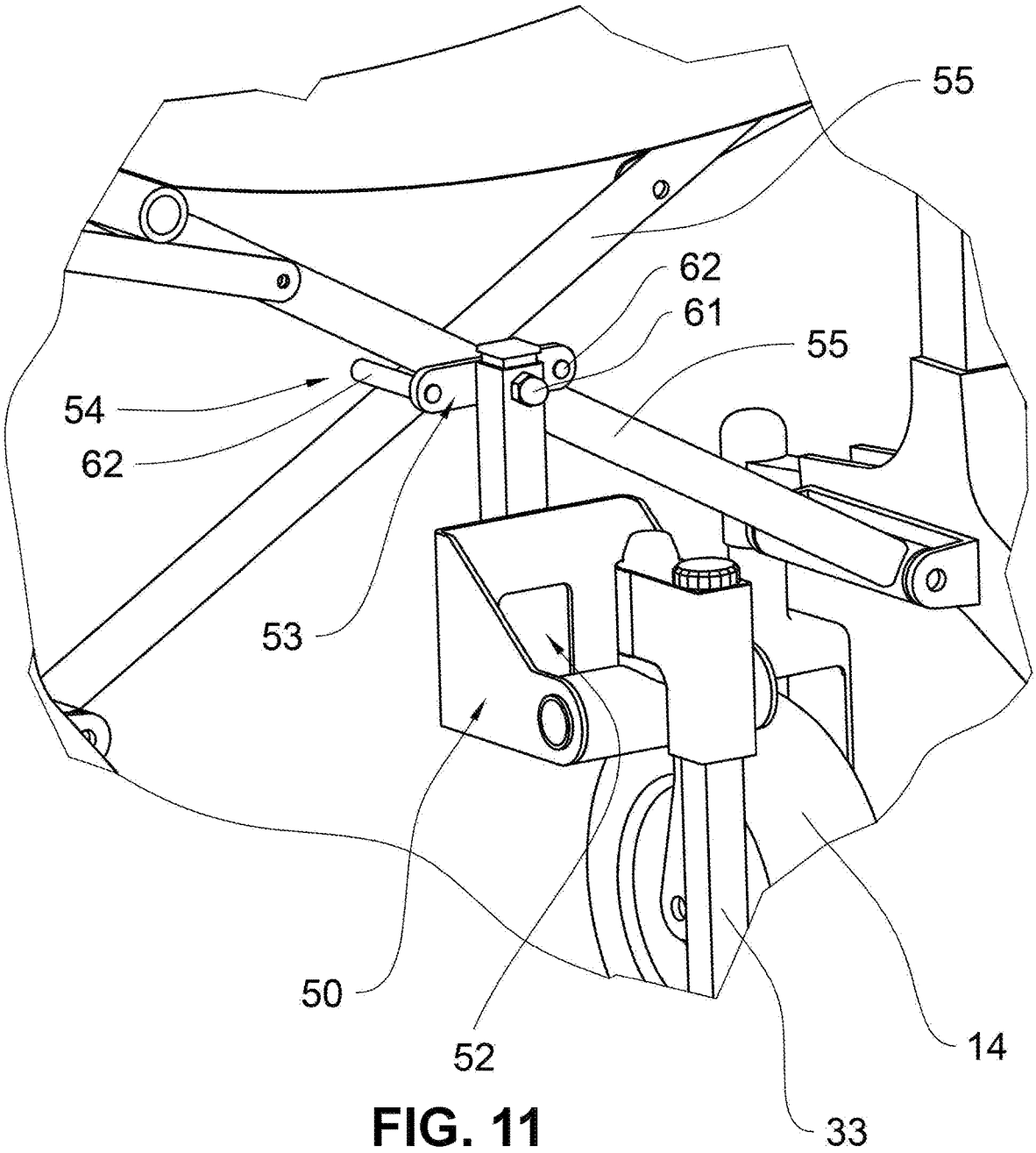
FIGS. 11 and 12 illustrates details of the platform attachment at the wheeled walker according to FIG. 10.
Figure 12:
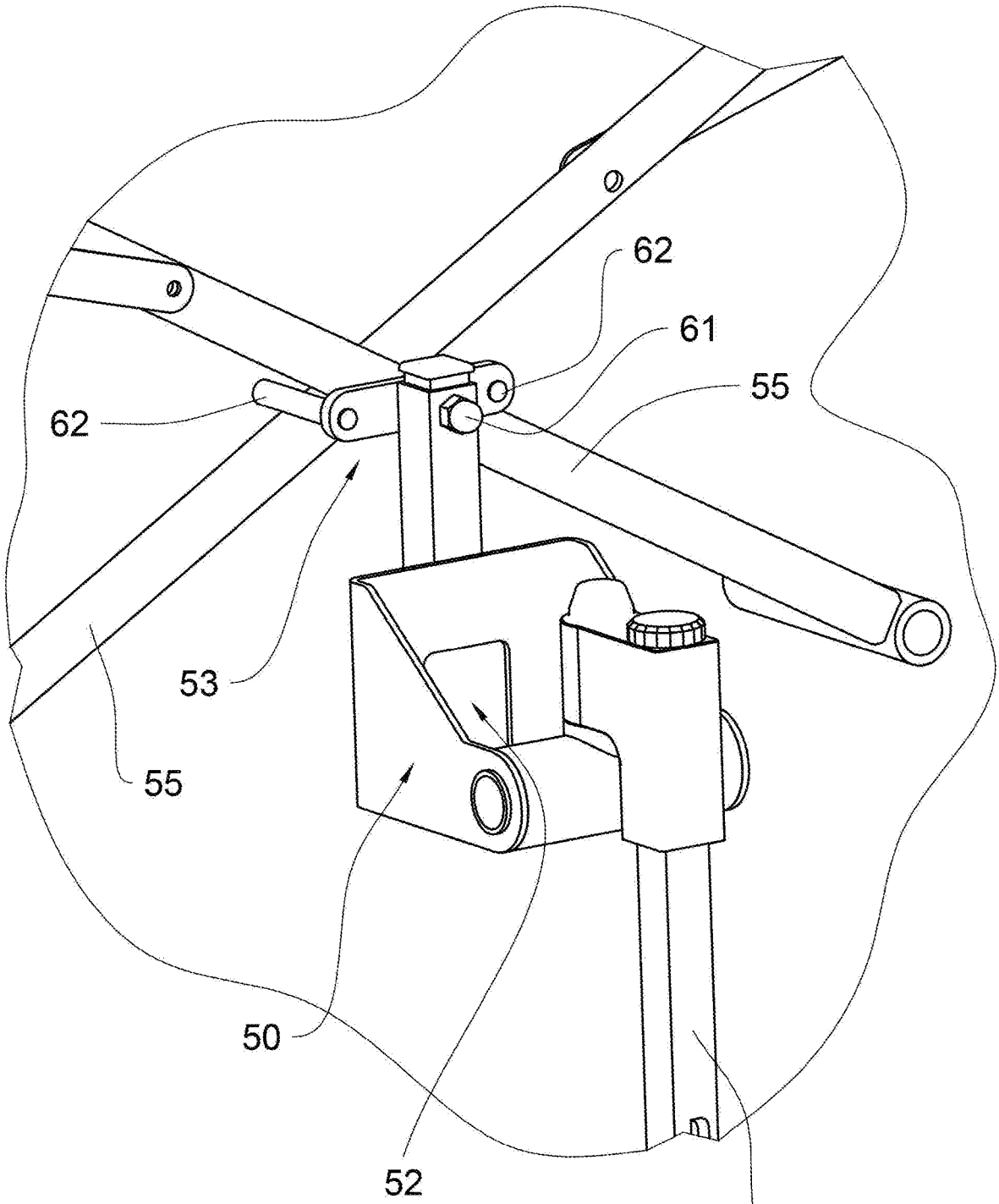

FIGS. 10-12 illustrate a wheeled walker 10 in an alternative embodiment in an overall view and in two detailed views wherein the alternative embodiment also includes a trailing platform 11 according to the invention. Differently from the wheeled walker 10 described supra the instant wheeled walker 10 is foldable using a scissor mechanism. In order to fix the platform 11 the coupling basket 50 recited supra is fixed at the scissor axis 61 that connects the scissor levers 55 wherein the scissor axis 61 is formed by a threaded bolt. An attachment bracket 53 which envelops the intersecting portion of the scissor levers 55 and wherein support struts 62 of the attachment bracket 53 sit on the scissor levers 55 so that the attachment bracket 53 prevents a lateral tilting of the platform 11. This reliably prevents a rotating or scissor movement about the scissor axis 61.

Figure 13:
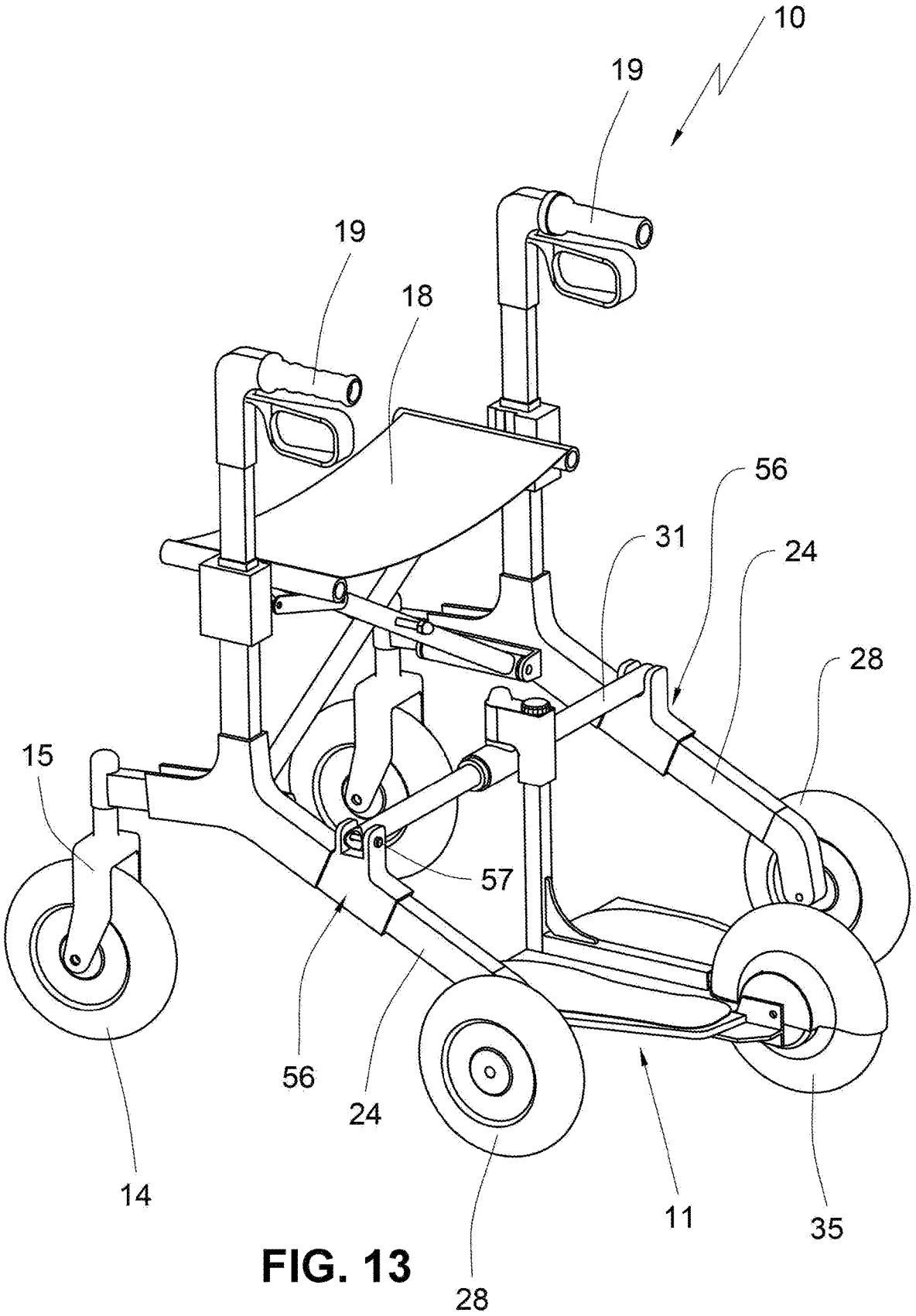
FIG. 13 illustrates the wheeled walker according to FIG. 10 with an alternative platform attachment.

FIG. 13 illustrates the wheeled walker 10 according to FIG. 9 with a platform 11 that is attached in an alternative manner. Thus, the struts 24 that support the rear wheels 28 are provided with receiving forks 56 wherein a coupling rod 31 is then inserted into the receiving forks. Therefore the platform 11 is fixed in analogy to the wheeled walker illustrated in FIG. 3.

It is advantageous in the embodiment according to FIG. 13 to pivotably arrange the coupling rod 31 in one of the receiving forks 56 through a threaded bolt 57. Alternatively however it is also conceive able that the coupling rod 31 is remove ably supported in the receiving forks 56 and secured therein by suitable fasteners.

It is also advantageous that the coupling rod 31 is fixed with its ends at the struts 24 advantageously using a central pivot link wherein the coupling rod 31 is foldable in the central pivot link when folding the wheeled walker 10.

Figure 14:
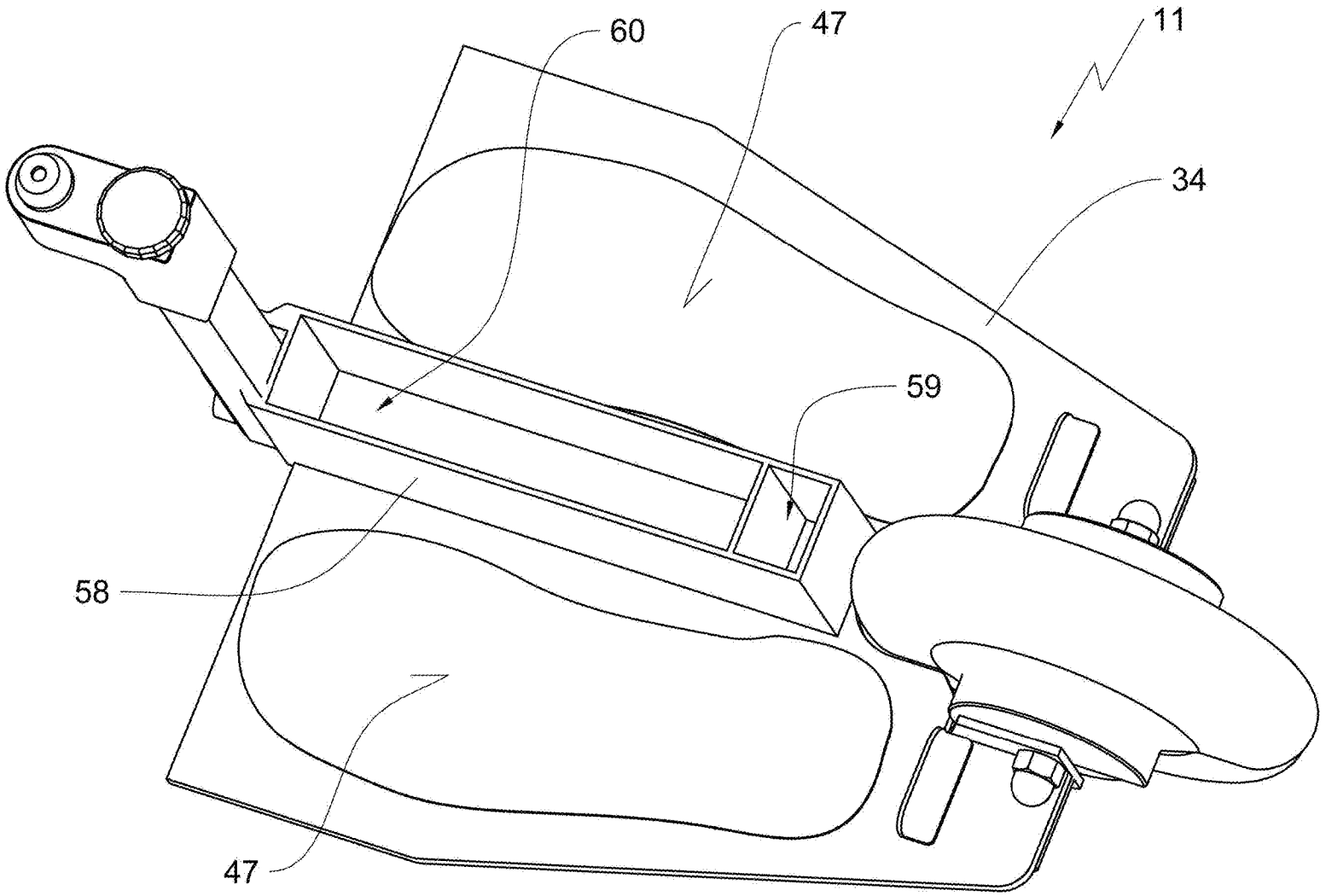
FIG. 14 illustrates an alternative platform in a detailed view.

Last not least, FIG. 14 illustrates an advantageous embodiment of the platform 11. This differs from the embodiment recited supra in particular in that a housing 58 is arranged on a top side of the board 34. This housing is shown open, this means without an associated cover. This housing includes a first receiving chamber 59 in which control electronics can be arranged. A second receiving chamber 60 is configured to receive an accumulator 39. Also here it is conceivable to retrieve the accumulator for charging. Alternatively charging contacts can be arranged at an outside of the housing 58 or at the accumulator housing in order to be able to charge the accumulator also during installation in the second receiving cavity.

The wheeled walker 10 can be provided with an optical or acoustic device like a bell or a horn in order to warn or alert traffic participants. When the wheeled walker includes a sensor that scans the drive path, the signalling device can be used to put out a warning signal in order to issue e.g. obstacle warnings. A break actuation can then be initiated by the motor control.

Advantageously the wheeled walker can be provided with lighting. This can be lighting in accordance to motor vehicle regulations. However, illuminating the drive path of the wheeled walker might be more important. Illuminating the drive path of the wheeled walker might facilitate a timely detection of obstacles or uneven ground when using paths that are not illuminated well.

A display at the wheeled walker or data coupling with a mobile device enables the user to display status information of the wheeled walker 10. This can include the charging condition, approximate range or speed. Advantageously a navigation function can be included.

The wheeled walker 10 according to the invention includes master switch proximal to one of the handles 19 or the coupling device 32. This master switch closes or disconnects the electrical connection between the power source and the electrical consumers, in particular the motor. A check light signals the position of the master switch.

The platform 11 can also be used as a drive component to drive other transport devices like baby carriages, wheel chairs or merchandise transport devices like e.g. carts for mail delivery services. When the platform 11 is used to drive a wheel chair an accompanying person can step onto the platform 11.

REFERENCE NUMERALS AND DESIGNATIONS

10 wheeled walker
11 trailing platform
12 frame
13 tubular rod linkage
14 front wheel
15 front wheel fork
16 wheel fork support
17 vertical rotation axis of 16
18 seat board/support board
19 handle
20 rear frame section
21 front frame section
22 support element of 21
23 bell crank lever
24 strut
25 slotted hole of 22
26 horizontal connecting rod
27 rear wheel fork
28 rear wheel
29 geometric rear axis
30 radial plane of 28
31 coupling rod
32 coupling device
33 vertical strut
34 board
35 platform wheel
36 protective device
37 fender
38 platform wheel fork
39 accumulator
40 thrust receiver
41 retaining bolt
42 sleeve section
43 support mandrel
44 rotation axis of 32
45 support sleeve
46 support arm
47 surface
48 fastener
49 clamping device
50 coupling basket
51 axle element of 50
52 thrust receiver
53 attachment bracket
54 intersection device of 55
55 scissor lever
56 receiving fork
57 threaded bolt
58 housing
59 first receiving chamber
60 second receiving chamber
61 scissor axis
62 support strut
64 clamp

What is claimed is:

1. A wheeled walker, comprising:

a front wheel pair viewed in a driving direction and a rear wheel pair viewed in the driving direction;

a frame including rearward oriented struts, wherein each ref the rearward oriented struts supports a rear wheel of the rear wheel pair;

a platform attached at the wheeled walker, wherein the platform includes at least one platform wheel and a standing platform for a person using the walker; and an electric drive that is configured to move the wheeled walker forward in the driving direction, wherein the wheeled walker includes a coupling device that attaches the platform at the wheeled walker and transfers pull forces and push forces between the wheeled walker and the platform, wherein the coupling device is arranged in an intersection portion of a scissor linkage that is pivotable about a pivot axis that is perpendicular to a rotation axis of the rear wheel pair in a top view.

2. The wheeled walker according to claim 1, wherein a standing surface of the platform is arranged between the rear wheels of the rear wheel pair.

3. The wheeled walker according to claim 1, wherein the platform includes a backward tapering standing surface.

4. The wheeled walker according to claim 1, wherein the platform includes at least one platform wheel at a rear end, and wherein the at least one platform wheel is configured as a drive wheel with an integrated electric motor.

5. The wheeled walker according to claim 4, wherein the platform includes an accumulator to supply the electric motor with power, and wherein the accumulator is arranged at a bottom side of the platform or at a top side of the platform.

6. The wheeled walker according to claim 1, wherein the coupling device includes a pivot joint that facilitates relative movements of the wheeled walker and the platform caused by jaw movements and that defines a rotation axis between the wheeled walker and the platform, and wherein a composite including the wheeled walker and the platform kinks at the rotation axis when driving around a turn.

7. The wheeled walker according to claim 1, wherein in the coupling device includes a horizontal axis, and wherein the platform is movable about the horizontal axis from a functional position into a storage position.

8. A wheeled walker, comprising:

a front wheel pair viewed in a driving direction and a rear wheel pair viewed in the driving direction;

a frame including rearward oriented struts, wherein each of the rearward oriented struts supports a rear wheel of the rear wheel pair;

a platform attached at the wheeled walker, wherein the platform includes at least one platform wheel and a standing, platform for a person using the walker; and an electric drive that is configured to move the wheeled walker forward in the driving direction, wherein the wheeled walker includes a coupling device that attaches the platform at the wheeled walker and transfers pull forces and push forces between the wheeled walker and the platform, wherein the coupling device is arranged in an intersection portion of a scissor linkage that is associated with the wheeled walker, or wherein the coupling device is part of a horizontal coupling rod that connects the rearward oriented struts that support the rear wheels, or wherein the coupling device is part of a horizontal coupling rod that connects the rear wheels or the rearward oriented struts wherein the horizontal coupling rod includes a folding joint wherein the coupling device is arranged in a portion of the folding joint, wherein in the coupling device includes a horizontal axis, wherein the platform is movable about the horizontal axis from a functional position into a storage, position, and wherein the platform is arranged below the coupling device in the functional position and supported in the coupling device by a vertical strut.

9. The wheeled walker according to claim 8, wherein the coupling device includes a thrust receiver that receives the vertical strut, and wherein the vertical strut is supported and displaceable in a linear manner in the thrust receiver.

10. The wheeled walker according to claim 8, wherein the coupling device includes alit assist that supports a movement of the platform from the functional position into the storage position, and wherein the lift assist is a mechanical lift assist or a lift spring.

11. The wheeled walker according to claim 8, wherein in the coupling device includes a horizontal axis, wherein the platform is movable about the horizontal axis from a functional position into a storage position, wherein the platform wheel includes a protective device that is rotatable about a platform wheel axis, and wherein the protective device is oriented towards the user of the wheeled walker and covers a running surface of the platform wheel in the storage position of the platform.

12. The wheeled walker according to claim 6, wherein the platform runs in trail within a surface that is limited laterally by radial planes of the rear wheels when running through a turn.

13. The wheeled walker according to claim 1, wherein the platform is disengageable from the coupling device.

14. The wheeled walker according to claim 8, wherein the platform is foldable along a longitudinal axis that is parallel to the driving direction.

15. The wheeled walker according to claim 6, wherein the coupling device is fixed torque proof relative to a longitudinal axis of the wheeled walker.

* * * * *